United States Patent [19]

Dearth et al.

[11] 4,421,169

[45] Dec. 20, 1983

[54] PROTECTIVE SHEATH FOR HIGH TEMPERATURE PROCESS WELLS

[75] Inventors: James D. Dearth, Houston; Herbert B. Wolcott, Jr., Plano, both of Tex.

[73] Assignee: Atlantic Richfield Company, Los Angeles, Calif.

[21] Appl. No.: 326,984

[22] Filed: Dec. 3, 1981

[51] Int. Cl.[3] ..... F21B 33/14; F21B 36/00

[52] U.S. Cl. ..... 166/285; 166/57; 166/209; 138/149

[58] Field of Search ..... 166/285, 288, 302, 57, 166/207, 208, 241; 138/149

[56] References Cited

U.S. PATENT DOCUMENTS

| | | | |
|---|---|---|---|
| 2,362,829 | 11/1944 | Kinley | 166/241 |
| 3,117,628 | 1/1964 | Myers | 166/208 |
| 3,119,451 | 1/1964 | Hall | 166/241 |
| 3,379,252 | 4/1968 | Heckler et al. | 166/205 |
| 3,380,530 | 4/1968 | McConnell et al. | 166/57 X |
| 3,677,340 | 7/1972 | Blount et al. | 166/302 |
| 3,820,605 | 6/1974 | Barber et al. | 166/57 X |
| 3,976,139 | 8/1976 | Wilder | 166/285 |
| 4,071,311 | 1/1978 | Errington | 138/149 X |

*Primary Examiner*—Ernest R. Purser
*Assistant Examiner*—Thuy M. Bui
*Attorney, Agent, or Firm*—Albert C. Metrailer

[57] ABSTRACT

Apparatus and method for maintaining the integrity of a cement sheath surrounding a casing in a hot subteranean zone including a layer of compressible refractory insulation surrounding the casing and at least one cement hanger slidably carried by said casing and means for limiting the movement of the hanger on the casing. The insulation layer mechanically isolates the sheath from thermal expansion of the casing and the slidable cement hanger likewise allows limited axial motion of the casing relative to the sheath without inducing tensile loads.

10 Claims, 2 Drawing Figures

PROTECTIVE SHEATH FOR HIGH TEMPERATURE PROCESS WELLS

BACKGROUND OF THE INVENTION

The present invention relates to methods and apparatus for protecting well casings in high temperature process wells and more particularly to methods and apparatus for maintaining the integrity of a high temperature protective cement sheath in such wells.

Casings are normally cemented into wellbores for a number of well-known reasons. For example, in addition to providing support for the casing, a cement sheath prevents fluid communication between different horizons through which the borehole passes. In wells used for high temperature processes such as underground coal gasification, the cement sheath serves another important function. The sheath protects and insulates the metal casing from the high temperatures involved. In the high temperature zone, the surrounding material, for example, coal, is normally burned away so that the common functions of the cement sheath are lost and the high temperature protection becomes the only function.

Most metal tubular goods melt or scale at temperatures of 1500° to 2200° F. Such materials lose substantial strength above 900° F. Refractory cements, on the other hand, are available which can withstand process temperatures in excess of 3000° F. A sheath of such cement can, therefore, provide good high temperature protection to the metal tubular goods if the sheath remains intact on the casing.

A number of factors tend to destroy cement sheaths in high temperature process wells. As noted above, the surrounding material is usually burned away after a combustion process has begun. For example in a UCG process, an oxygen-containing gas is typically injected at the bottom of a coal seam and the coal is ignited at this point. As combustion proceeds, a burning rubble pile is formed in the lower portion of the zone with the gas injected into the lower portion of the rubble pile. As the coal falls away from upper portions of the zone, all of the original formation support of the cement sheath is lost. The sheath is then exposed to the highest temperatures of the process without any mechanical support or heat shielding by the original coal formation. As the injection well heats up to process temperatures, the metal casing itself expands at a higher rate than the cement sheath. This differential expansion places the cement sheath in tension, both axially and radially. Due to the known lack of tensile strength of cement materials, the sheath tends to crack and fall away from the casing which is then burned or melted through by the process temperatures.

It is apparent that the cement sheath would not normally be destroyed by process temperatures except in the high temperature zone itself. Likewise, the metal casing would tend to be destroyed only within the zone. Even after loss of these portions of the casing, it is clear that air or other combustion gases could be injected into the zone. However, it is considered very desirable, and possibly essential, to most combustion processes that the injected gases enter the combustion zone at the lowest point possible. For this reason, it is desirable to provide a reliable cement sheath around the injection casing.

SUMMARY OF THE INVENTION

Accordingly, an object of the present invention is to provide a high temperature process well casing having a durable cement sheath.

Another object of the present invention is to provide apparatus for use in high temperature process wells for maintaining the integrity of a high temperature protection cement sheath.

Yet another object of the present invention is to provide a method for preventing failure of protective cement sheaths in high temperature process wells.

Apparatus according to the present invention includes a compressible refractory insulation layer surrounding a casing, at least one cement hanger slidably carried by said casing, and clamp means carried by said casing for limiting the movement of the cement hanger along the casing. A cement sheath is formed around the casing in contact with the cement hanger and the outer surface of the refractory insulation. The cement hanger provides support for the cement sheath while allowing for limited axial sliding of the casing relative to the sheath to reduce longitudinal tension within the sheath. The refractory insulating material, in addition to providing thermal insulation, isolates the cement sheath from stresses normally caused by radial expansion of the casing.

BRIEF DESCRIPTION OF THE DRAWINGS

The present invention may be better understood by reading the following detailed description of the preferred embodiment with reference to the accompanying drawings wherein.

DESCRIPTION OF THE PREFERRED EMBODIMENTS

Figure 1:
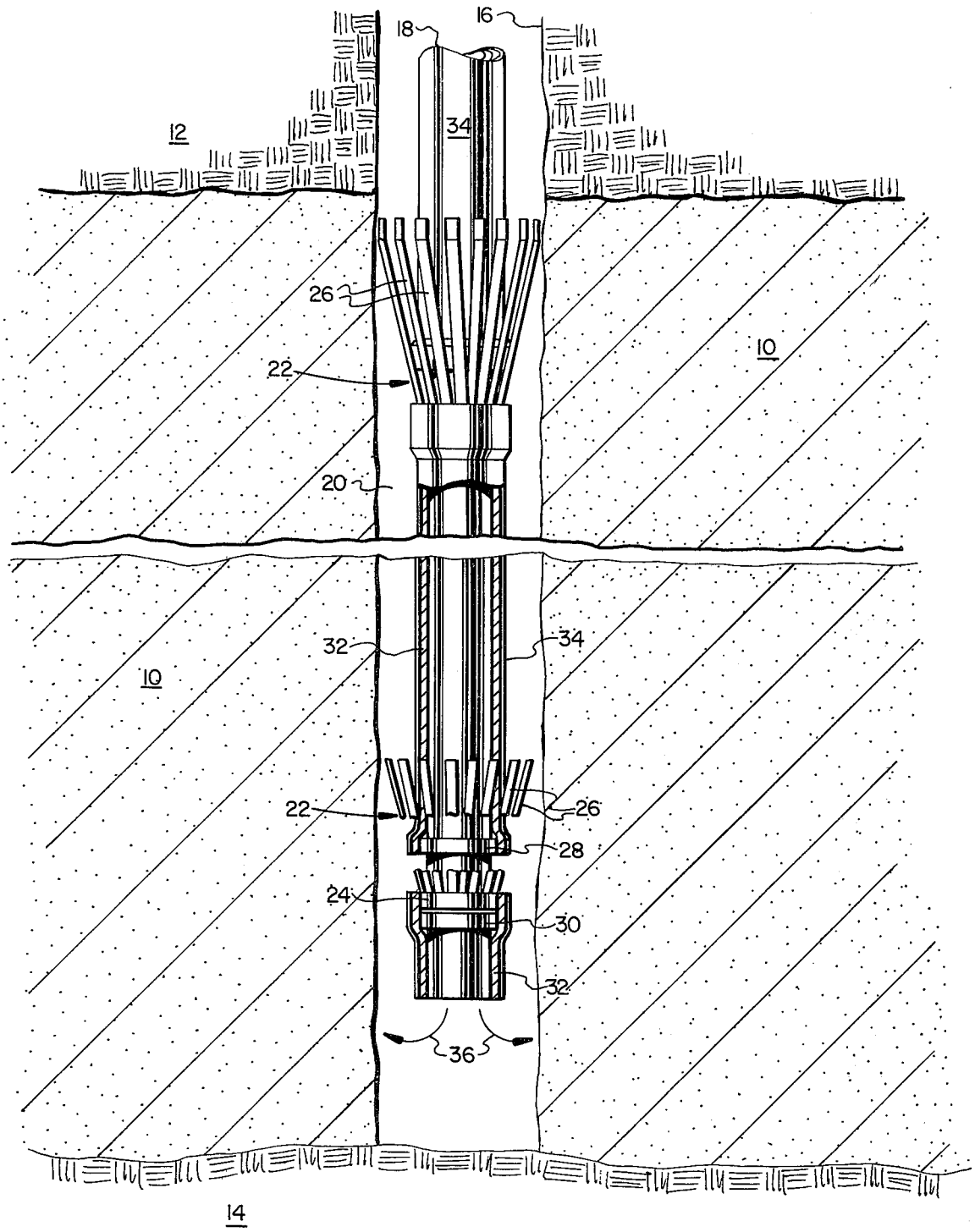
FIG. 1 is a partially cross-sectional view of a gas injection casing positioned in a borehole within a coal seam prior to formation of a protective cement sheath.

With reference now to FIG. 1, there is illustrated an underground coal seam 10 positioned between upper and lower rock or earth layers 12 and 14. A borehole 16, originating at the earth's surface, is shown extending through rock layer 12 and coal seam 10. Borehole 16 would normally have a diameter of 8.625 inches and would terminate approximately at the upper edge of rock zone 14. Positioned within borehole 16 is a tubing or casing 18 through which process gases will be injected to support combustion of coal seam 10. In a typical installation, casing 18 would have an outer diameter of 2.875 inches. As illustrated, no cement has yet been placed in the annulus 20 between casing 18 and the walls of borehole 16. Casing 18 has, however, been prepared for supporting a cement sheath in accordance with the present invention. In particular, a pair of cement hangers 22 are illustrated (the lower one shown partially broken away) supported upon casing 18. Each of the hangers 22 includes a collar 24 loosely carried upon casing 18 so that the collar may freely slide along the length of the casing. Each hanger 22 further includes a plurality of steel straps 26 extending from collar 24 upwardly and outwardly.

In initial installations according to the present invention, the cement hanger 22 will be formed from a commercially available cement basket. Such cement baskets are normally intended to protect porous or weak formations by isolating them from the fluid pressure of a cement column. The conventional baskets, therefore, include a fabric liner which forms a fluid seal preventing the downward flow of fluids. In the present invention, such liners will be removed leaving only the steel straps 26. It may also be desirable to reduce the normal length of straps 26 (as is illustrated in the lower hanger 22) so that when installed, they will not extend to the face of borehole 16.

Experience may show that other forms of hanger straps 26 are preferred. For example, it may be desirable for straps 26 to extend radially outwardly from casing 18 rather than angularly as illustrated. The use of square or round cross section rods in place of straps 26 may also prove to be desirable.

A pair of claims 28 and 30 are attached to casing 18 above and below collar 24. Essentially, any commercially available clamp which will limit the sliding of cement hanger 22 along casing 18 is suitable. Depending upon the positioning of the cement hanger 22 along casing 18, one or the other of clamps 28 and 30 may be replaced by a collar connecting sections of casing 18 together.

It is believed that use of a hanger 24 and set of clamps 28 and 30 at intervals of three to ten feet along casing 18 should be suitable. Experience may show that other spacings are preferred, especially if the configuration of hanger 22 is modified.

Also illustrated in FIG. 1 is a layer or blanket of refractory insulation 32. As illustrated in FIG. 1, blanket 32 preferably surrounds all exposed sections of casing 18 within the coal seam 10. The blanket 32 is also formed over the clamps 28 and 30 and the sliding collar 24 of cement hanger 22. As will be discussed in more detail below, the refractory blanket 32 not only provides additional thermal protection for casing 18, but prevents the direct contact of the cement sheath with casing 18. Materials which are believed to be useful as blanket 32 include those sold under the trademark Fiberfrax TM by The Carborundum Company of Niagara Falls, N.Y. and under the trademark Kaowool TM by The Babcock and Wilcox Company of Augusta, Ga. Other similar materials which are both refractory and compressible would also be suitable. The refractory blanket 32 is preferrably surrounded by a waterproof protective layer 34 formed from a material such as aluminum foil. The layer 34 is intended to protect the blanket 32 during placement and to prevent saturation with the cement material but does not have to withstand process temperatures. Various methods for attaching such insulation layers to casing are illustrated in my co-pending application Ser. No. 263,625, filed May 14, 1981.

After the apparatus has been positioned as shown in FIG. 1, the cement sheath may be formed using conventional cementing techniques. That is, the cement slurry would be pumped down tubing 18 and circulated back up the annulus 20 as illustrated by the arrows 36. As is conventional, some type of cement shoe and/or ball valve arrangement would normally be included on the lower end of casing 18 to prevent reverse circulation of cement after it has been placed in the annulus 20. It is also apparent that the entire borehole 16 may be cemented in a single operation using conventional cement compositions in the upper portion and castable refractory materials in the coal seam or other high temperature portion.

Figure 2:
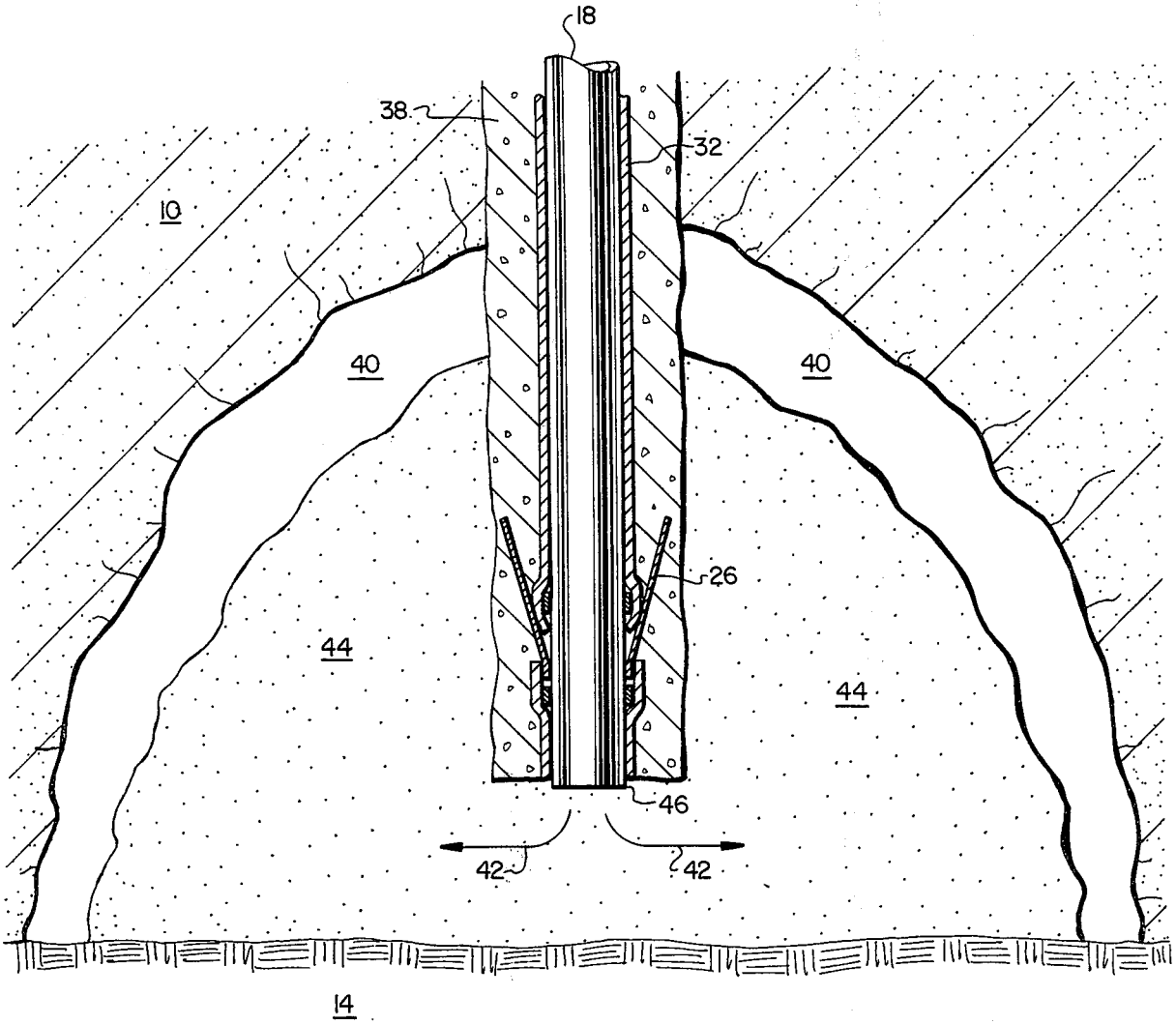
FIG. 2 is a cross-sectional view of a portion of the injection casing of FIG. 1 after formation of a protective cement sheath and initiation of a coal gasification process.

With reference now to FIG. 2, the present invention is illustrated after placement of a cement sheath 38 and initiation of a combustion process. In FIG. 2, the original annulus 20 has not been replaced by the sheath 38. As can be seen in cross section, the cement engaging arms 26 are now embedded within the sheath but preferably do not extend to the outer surface thereof. The insulating layer 32 provides not only thermal insulation of casing 18 but also mechanically isolates casing 18 from the sheath 38. The foil layer 34 is not illustrated in FIG. 2 since it will typically have been destroyed by process temperatures.

In FIG. 2, a cavity 40 has been formed in the original coal seam 10 by the combustion process. Ignition began at the lower end of casing 18 through which combustion gases are injected as illustrated by the arrows 42. A portion of the coal has fallen into a burning rubble pile 44. To insure the most complete combustion of the material in pile 44, it is very desirable that casing 18 remain intact and continue supplying the combustion gases to the lower portion of the pile. It can be seen that the outer surfaces of sheath 38 have lost mechanical support and are exposed to the temperatures of the burning gases in the process. Due to the differences in thermal coefficients of expansion, it is expected that casing 18 will extend longitudinally somewhat beyond the lower end of sheath 38 as illustrated at its lower end 46. As this occurs, it is expected that clamp 28 will move downwardly from collar 24 leaving a space therebetween as illustrated. The ability of collar 24 to slide on casing 18 thereby prevents the transmission of forces from casing 18 to sheath 38. Likewise, casing 18 is expected to expand radially relative to sheath 38. Since refractory blanket 32 is compressible, it will greatly reduce the transmission of these mechanical forces to sheath 38. It is expected that this mechanical isolation will dramatically improve the reliability of sheath 38.

As disclosed in my above-referenced co-pending application Ser. No. 263,625, the casing 18 can be effectively cooled by the injected process gases. As noted in that application, a combination of the gas cooling with sufficient thermal insulation will maintain casing 18 in a safe operating temperature range. Initial designs of the present invention called for blanket 32 to be on the order of one to two inches thick in order to provide considerable thermal insulation. A much thinner layer, on the order of one-quarter to one-half inch, is suitable for providing sufficient thermal expansion isolation. It is now believed that the thinner blanket is actually preferred from a thermal analysis point of view also. The injected gases normally provide sufficient cooling to maintain safe casing operating temperatures even with the thinner insulation layer 32. While the thicker layer would result in lower casing temperature, it would also result in much higher temperatures within sheath 38. While the material of sheath 38 is intended to withstand the extremely high temperatures, its expected lifetime can be extended by the cooling action of the injected gases. For these reasons, it is expected that a design thickness of between one-quarter and one-half inch will normally be specified for blanket 32.

While the present invention has been illustrated and described with reference to particular apparatus and methods of use, it is apparent that various modifications and changes can be made therein within the scope of the present invention as defined by the appended claims.

What is claimed is:

1. Apparatus for supporting and maintaining the integrity of a cement sheath formed in-situ between a casing and a borehole wall in a hot subterranean zone;

a layer of compressible refractory insulation surrounding said casing;

at least one cement hanger slidably carried by said casing, said hanger including a plurality of cement engaging arms extending outwardly from said casing; and clamp means fixedly carried by said casing for limiting the movement of said hanger along said casing;

whereby said sheath is isolated from thermally induced stresses.

2. Apparatus according to claim 1 wherein said cement hanger includes a collar slidably carried on said casing and said cement engaging arms each comprise a steel strap having a first end attached to said collar and a body portion extending angularly away from said collar.

3. Apparatus according to claim 2 wherein said layer of refractory insulation also surrounds the collar portion of said hanger.

4. Apparatus according to claim 1 wherein said clamp means comprise first and second collars carried by said casing at points spaced above and below said cement hanger.

5. Apparatus according to claim 4 wherein said layer of refractory insulation also surrounds said first and second collars.

6. An apparatus for fluidly communicating the surface with a hot subterranean zone comprising:

a casing fluidly communicating said hot zone and said surface;

a layer of refractory insulation surrounding a lower portion of said casing positioned with said zone;

one or more cement hanger means slidably supported by said lower portion of said casing, each hanger means including a plurality of cement engaging arms extending outwardly from said casing;

clamp means carried by said lower portion of said casing for limiting the movement of said hanger means along said casing; and a cement sheath surrounding said layer of insulation, said cement sheath formed in-situ between said insulation and a borehole wall and attached to and supported by said cement engaging arms of said cement hangers.

7. Apparatus according to claim 6 wherein:

said cement hanger means includes a collar slidably carried on said lower casing portion and said cement engaging arms each comprise a steel strap, having a first end attached to said collar and a body portion extending angularly away from said collar.

8. Apparatus according to claim 6 wherein:

said clamp means comprises, for each cement hanger, first and second clamps fixedly carried by said casing at points spaced above and below said cement hanger means for limiting motion of said hanger means along said casing.

9. A method for supporting and maintaining the integrity of a cement sheath formed in-situ between a casing and a borehole wall in a hot subterranean zone:

slidably positioning a cement hanger on said casing, said hanger including a plurality of cement engaging arms extending outwardly from said casing for engaging said sheath;

limiting the axial motion of said hanger along said casing; and wrapping all exterior surfaces of said casing and said hanger, except said cement engaging arms, with a layer of compressible refractory insulation.

10. A method according to claim 9 further including the step of wrapping said insulation with a layer of waterproof material.

* * * * *